US005778712A

United States Patent [19]

Walldén

[11] Patent Number: 5,778,712

[45] Date of Patent: Jul. 14, 1998

[54] CYLINDER LOCK/KEY COMBINATION, A KEY AND A KEY BLANK THEREFOR

[75] Inventor: Lars Walldén, Eskilstuna, Sweden

[73] Assignee: ASSA AB, Eskilstuna, Sweden

[21] Appl. No.: 776,393

[22] PCT Filed: Jul. 26, 1995

[86] PCT No.: PCT/SE95/00886

§ 371 Date: Jan. 28, 1997

§ 102(e) Date: Jan. 28, 1997

[87] PCT Pub. No.: WO96/03562

PCT Pub. Date: Feb. 8, 1996

[30] Foreign Application Priority Data

Jul. 28, 1994 [SE] Sweden ..... 9402588

[51] Int. Cl.[6] ..... E05B 15/08

[52] U.S. Cl. ..... 70/453; 70/420; 70/407

[58] Field of Search ..... 70/419, 420, 453, 70/454, 402–404, 405–407, 409, 416–418

[56] References Cited

U.S. PATENT DOCUMENTS

| | | | |
|---|---|---|---|
| Re. 9,787 | 7/1881 | Schade | 70/453 X |
| 446,176 | 2/1891 | Shaw | 70/453 |
| 702,333 | 6/1902 | Schrauder | 70/453 X |
| 877,980 | 2/1908 | Katzenberger . | |
| 1,477,318 | 12/1923 | Crass . | |
| 1,499,211 | 6/1924 | Giralico | 70/420 X |
| 1,730,662 | 10/1929 | Kobus | 70/420 X |
| 1,932,706 | 10/1933 | Neer | 70/47 |
| 2,395,762 | 2/1946 | Rober | 70/453 X |
| 3,128,618 | 4/1964 | De Vines | 70/420 X |
| 3,597,948 | 8/1971 | Johnstone | 70/453 X |
| 3,736,780 | 6/1973 | Singer | 70/453 |
| 4,069,693 | 1/1978 | Spalding | 70/453 X |
| 4,148,201 | 4/1979 | Miyamae et al. | 70/419 X |
| 4,686,843 | 8/1987 | Martikainen et al. | 70/453 X |
| 5,088,306 | 2/1992 | Field | 70/453 X |

FOREIGN PATENT DOCUMENTS

| | | | |
|---|---|---|---|
| 2565281 | 12/1985 | France . | |
| 2611225 | 8/1988 | France | 70/453 |
| 217799 | 5/1909 | Germany . | |
| 378347 | 7/1923 | Germany | 70/453 |
| 529774 | 7/1931 | Germany | 70/453 |
| 653884 | 4/1963 | Italy | 70/453 |
| 27407 | 12/1907 | United Kingdom | 70/453 |

*Primary Examiner*—Suzanne Dino Barrett
*Attorney, Agent, or Firm*—Sughrue, Mion, Zinn, Macpeak & Seas, PLLC

[57] ABSTRACT

A cylinder lock/key combination includes a lock cylinder (2), a plug (3) rotatably mounted in the cylinder (2) and having a key slot (4), and a number of tumbler pins (6) that are activatable by the code (5*a*) on the key (5). The key slot carries or houses an element (7) which extends axially along a substantial part of the slot. The key (5) has a blade part (5*c*) which includes an axially extending portion (5*d*) in which there is provided a hole (8) for receiving the slot-carried element (7) as the key is inserted into the lock. The slot-carried element (7) and the hole (8) provided in the key (5) are located eccentrically in relation to the center of the plug (3) and accompany rotation of the plug while aided by the key (5). The profile shape of the slot-carried element (7) and the hole (8) in the key may vary within wide limits. The invention also relates to a key belonging to a combination of the aforementioned kind, and to a key blank from which such a key can be produced.

12 Claims, 2 Drawing Sheets

CYLINDER LOCK/KEY COMBINATION, A KEY AND A KEY BLANK THEREFOR

TECHNICAL FIELD

The present invention relates to a cylinder lock/key combination of the kind defined in the preamble of claim 1. The invention also relates to a key and to a key blank.

Cylinder locks of the kind in which the key slot accommodates in the rotational centre of the lock plug an element which makes the insertion of a lock-picking tool difficult to achieve, and keys that are designed for use with such locks, are known for instance from DE-C-36 12 38 (Bergmann), DE-C 6 42 131 (Hermann Bode in Hannover), U.S. Pat. No. 877,930 (Katzenberger) and FR-A-2,525,267 (Toutain).

One common drawback with these constructions is that if the tumbler pins housed in the cylinder and the plug need to be changed, for instance when re-coding the lock or because one or more tumblers have been damaged, this change cannot be effected conventionally in the actual place where the lock is fitted.

A slot-carried element of the aforesaid kind fitted axially in the key slot of the plug affords the advantage of making the insertion of a lock-picking tool into the key slot difficult. However, because of the difficulty in carrying out on-site tumbler changes with the aid of a tool of the kind referred to, this type of lock has been unsuccessful commercially, despite being difficult to pick.

A tumbler change often requires the use of a tool which can be passed through the plug from beneath. The tool is used to force the tumblers out of their respective chambers, so as to enable a new set of tumblers and associated springs to be inserted and the tumbler chambers in the cylinder closed.

The cylinder and the fitted plug is then ready to be fitted in place for continued use, optionally together with a new key if it has been found necessary to re-code the lock as a result of changing tumbler pins.

DE-C-217 799 (Hartmann) describes a padlock whose key includes a bore or recess whose profile can vary in accordance with the profile shape of a pin element provided in the lock and onto which the key is inserted. This pin element is non-rotatable and forms a key turning centre.

U.S. Pat. No. 1,932,706 (Neer) describes a lock construction that includes a central key journalling centre having a round shape. The key code has the form of a screw-thread.

U.S. Pat. No. 1,477,318 (Crass) describes a type of lock which includes a slot-carried element wherein the coding shall face downwards in order for the key to be inserted into the key opening in the plug. The key is thus profiled only in the actual inlet to the plug. The key does not lift the tumbler pins as it is inserted into the lock, and the lock is therefore of the lever tumbler kind, i.e. a lock in which the tumbler pins are not activated until the key is turned. The slot-carried element forms a bearing, i.e. a centre for rotation of the key. The preamble of the following claim 1 includes features that are characteristic of this known lock.

In this lock, the slot-carried element referenced 16 in FIGS. 2 and 5 forms a stop surface which supports the tumbler pins in the absence of a key in the lock. That part of the key which embraces the slot-carried element is thick and has a regular shape. This means that the lock can be easily picked by inserting a lock-picking tool into the keyhole in the absence of a.

OBJECTS OF THE INVENTION

One object of the present invention is to provide a cylinder lock/key combination which includes a slot-carried element and which is an improvement on earlier known combinations, and with which the slot-carried element can be given a novel function, namely a function of enabling keys to be produced with very thin, curved and irregular profiled parts which make picking of the lock with a lock-picking tool difficult to accomplish.

Another object of the invention is to provide a cylinder lock/key combination which includes a slot-carried element which is able to coact with a tumbler pin replacement tool which can be used to remove all tumblers in the plug and the cylinder respectively after being inserted, despite the fact that the slot-carried element makes picking of the lock difficult to accomplish.

Another object of the invention is to provide a cylinder lock/key combination where the key has a novel and modified profiled shape.

SUMMARY OF THE INVENTION

These and other objects are fulfilled by an inventive lock/key combination having the features set forth in the characterizing clause of claim 1.

There has been created a novel concept in the manufacture of lock and key combinations which is distinguished from the known technique in which the slot-carried element is located in the rotation centre of the plug and the key respectively and which does not normally rotate together with the plug, even though this is possible in accordance with the known technique, insomuch that a) the slot-carried element is positioned eccentrically and may be removably fitted in the key slot, or keyhole, and accompanies its rotation;

b) the slot-carried element can thereby be given a different and novel function, namely the function of enabling the manufacture of keys that have very thin, curved and irregular profiled parts which make picking of the lock with a lock-picking tool difficult to accomplish;

c) illegal copying of a key is made difficult, among other things because conventional key blanks lack sufficient thickness to leave a sufficiently thick region of material on one or both sides of the slot-carried element after having formed the hole or the recess that receives the slot-carried element; and by the fact that d) a pin-removal tool of conventional design can be used despite the presence of the slot-carried element.

It can also be mentioned in this regard that serious limitations are found with respect to the manufacture of conventional keys with regard to the profiled shape and thickness of the key blade. This limitation is related to the broach or drawing tool used to shape the key slot or the hole (bore).

The broach is weak so that no accuracy or precision can be maintained when part of the cross-section of the slot becomes too thin.

For instance, in practice no cross-sectional measurement of the key slot may be smaller than 0.8–1 mm, which is thought to be the thinnest section preferred.

The present invention eliminates this limitation with regard to producing the key slot in the plug and in producing a corresponding key blade profile.

Instead, the key slot can be made abnormally broad in the region of the spine or bottom edge of the key, which is a positive criterion with regard to the broaching tool. Application of the bore slot-carried element which coacts with the axial hole, bore or recess provided in the key enables relevant profiled parts of the key blade adjacent the hole or recess to be made unusually thin, which results in the aforesaid particular advantages afforded by the inventive lock/key combination without having serious consequences with regard to the use of a broach tool in connection with the key slot formed in the plug.

It is preferred in practice that the slot-carried element can be removed from the plug after removing the lock cylinder from the lock housing.

This feature characteristic of the inventive lock/key combination facilitates the aforedescribed exchange of tumbler pins on the user site, for instance in conjunction with changing the code of the cylinder lock. At the same time, it is ensured that the slot-carried element cannot be removed, for instance by a person attempting to pick the lock.

In this regard, the slot-carried element is preferably mounted eccentrically on an end plate which can be fitted removably to the plug.

An inventive cylinder lock/key combination preferred in practice in which the plug includes a row of tumbler pins whose axes in one starting position of plug rotation in which a tumbler dividing plane is formed between tumblers accommodated in the core and in the lock cylinder, lie in a symmetry plane through the centre of the plug is characterized in that an axially extending line through the slot-carried element and the centre region of the hole or recess lies on one side of said symmetry plane.

In other words, the eccentrically located slot-carried element may be placed on one side of a symmetry plane that extends through the centre of the tumblers in that row of tumblers with which the coded surface of the key coacts and through the geometrical axis of the plug.

Although not necessary, the slot-carried element may be round. For instance, the slot-carried element may have a square, rectangular or polygonal cross-sectional shape as an alternative to a round shape. Furthermore, it lies within the concept of the invention to use a slot-carried element which has an irregular or asymmetric cross-sectional shape, even though this would lead to difficulties in providing the key with a hole of corresponding profiled shape.

It is preferred in practice that the slot-carried element has a diameter or largest thickness of between 1 and 3 mm. It is also preferred that the width of the key slot in the region of the spine or bottom of the key is of the order of 3–3.5 mm.

The walls that define the element-receiving hole or recess in the key may include projections and/or hollows which give the key a form that is difficult to copy.

It is best in practice for the key to include a round hole which receives the slot-carried element as the key is inserted into the key slot in the plug. The key blade of a key provided with such a hole will have the requisite stiffness, even though the walls defining the hole, or bore, are thin. This is therefore the preferred key design. However, it also lies within the concept of the invention to provide the key with a recess which extends along the key blade and in which the slot-carried element is received, instead of a hole. The function of the recess corresponds to the function of a hole, despite not being completely encased by material. This design reduces the stiffness of the key blade part, although this can be compensated for by producing the key from a more robust material, optionally a resilient material.

It is preferred that the slot-carried element extends along a substantial part of the length of the slot.

The invention also relates to the key of a combination of the aforesaid kind. The main characteristic features of such a key are set forth in the claims. A key blank from which such a key can be produced is also defined.

According to one preferred embodiment, the material that defines the hole is relatively thin, at least in parts, e.g. has a thickness of less than 1 mm, suitably less than 0.7 mm and preferably less than 0.5 mm.

It is not normally possible to produce a key-slot part whose thinness corresponds to a key-part that has a thickness of only 0.4 mm, for instance. As mentioned in the aforegoing, it is impossible in practice to produce these slot parts with a corresponding small thickness when using a broach. This problem is eliminated in a surprisingly simple manner when using a slot-carried element design in accordance with the invention. The relevant region of the key slot is broached with a tool of normal thickness or of a thickness larger than normal. Because of the presence of the slot-carried element, those parts of the key that embrace said element can be given said very small thickness.

It thus lies within the scope of the invention to give the key a more or less scrolled form which varies within wide limits, where certain parts of the scroll have very small thicknesses.

BRIEF DESCRIPTION OF THE DRAWINGS

The present invention will now be described in more detail with reference to exemplifying embodiments thereof and also with reference to the accompanying drawings, in which.

DETAILED DESCRIPTION OF THE PREFERRED EMBODIMENTS

Figure 1:
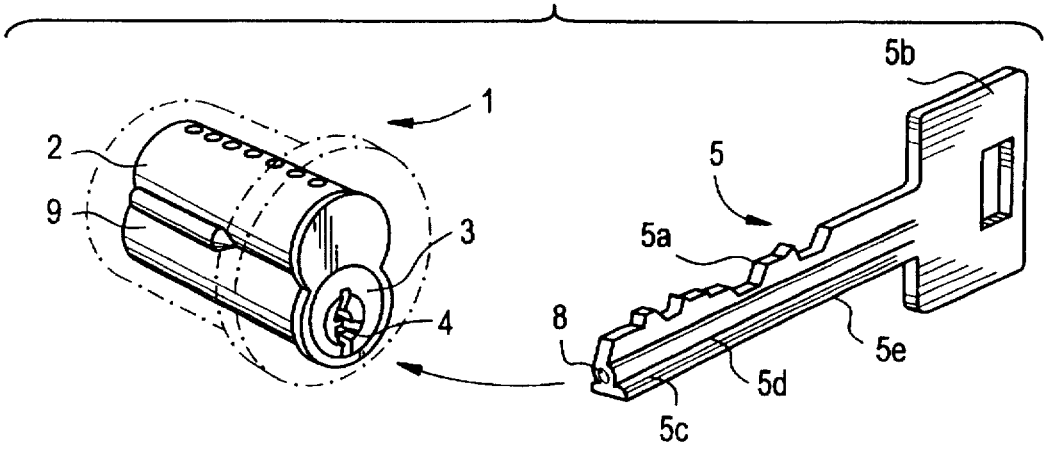
FIG. 1 is a perspective illustration of an inventive cylinder lock and associated key.

A cylinder lock/key combination includes a lock cylinder 2, a plug 3 rotatably mounted in the cylinder, and an associated key 5.

The plug 3 includes a key slot 4 and a number of tumbler pins 6 which can be activated or shifted by the coding 5*a* on the key 5. Disposed in the key slot 4 along the whole of its length, or along a substantial part of its length, is an axially extending element 7, which may have a varying profile.

The key 5 also includes a grip part 5*b* and a coded blade part 5*c*, an axially extending part 5*d*, and a hole or bore 8 which extends along the part 5*d* and which receives the slot-carried element 7 as the key is inserted into the lock.

The slot-carried element 7 and the hole 8 in the key 5 are disposed eccentrically in relation to the centre of the plug 3 and accompany rotational movement of the plug, aided by the key 5.

Figure 2:
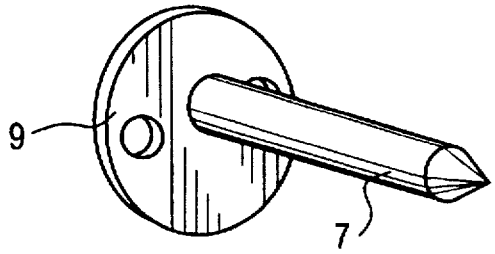
FIG. 2 is a perspective view of a dismountable end plate which is fitted on the cylinder of a cylinder lock according to FIG. 1 and which is provided with an eccentrically mounted slot-carried element.

As shown in FIG. 2, the slot-carried element is mounted eccentrically on an end plate 9 which can be attached removably to the cylinder 2. The slot-carried element can thus only be removed when dismantling the cylinder 2 from the lock housing 1.

Figure 3:
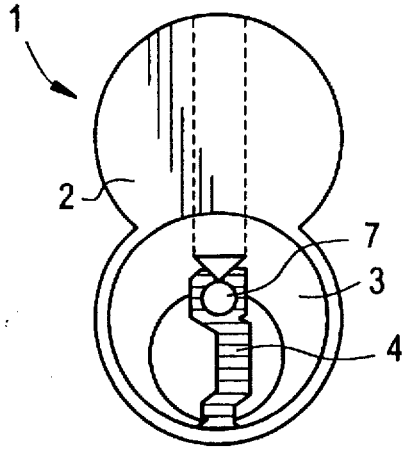
FIG. 3 is a partly cut-away front view of the cylinder lock shown in FIG. 1.

In the embodiment shown in FIGS. 1 and 3, the slot-carried element lies in a vertical symmetry plane through the lock cylinder. The element 7 is disposed eccentrically in relation to the plug, i.e. the axis of said element 7 extends parallel with and above the centre line of the plug 3.

Figure 4:
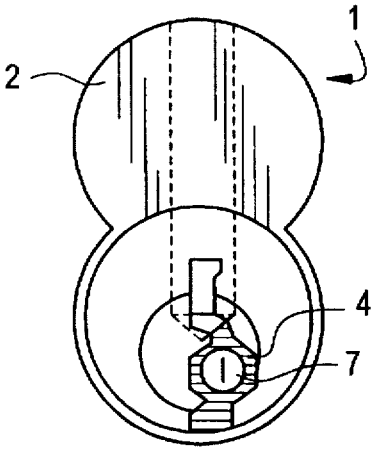
FIGS. 4 and 5 are front views of alternative embodiments corresponding to FIG. 3, in which the slot-carried element is laterally offset and has a round and a square cross-sectional shape respectively.

As shown in FIG. 4, the plug 3 has disposed therein a row of tumbler pins 6 whose axes lie in a symmetry plane of the plug centre when in the illustrated starting position of plug. Insertion of the key 5 therewith provides a tumbler pin parting plane between the upper tumbler pins in the plug 3 and the lower tumbler pins in the cylinder 2.

Figure 5:
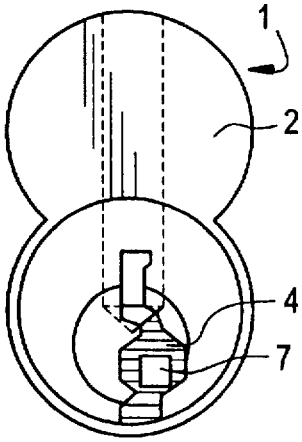
Figure 6:
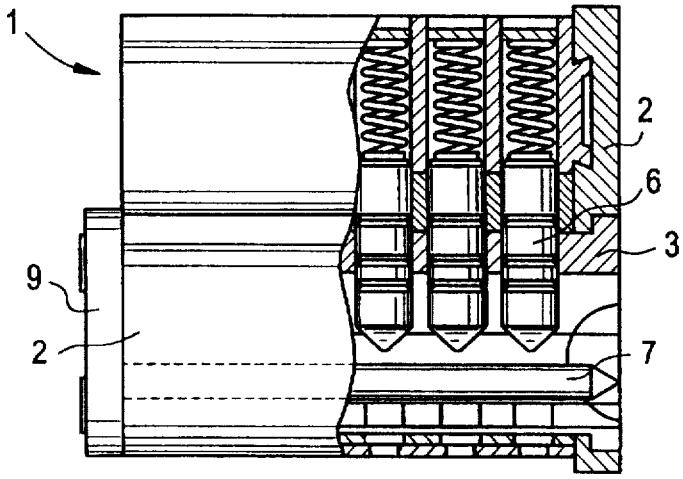
FIG. 6 is a partially cut-away side view of a cylinder lock according to FIG. 4.

It will be seen from FIGS. 4 and 5 that an axial line through the centre region of the slot-carried element 7 and the hole 8 lies on one side of said symmetry plane, i.e. the slot-carried element 7 extends parallel with the centre line of the plug but is offset laterally in relation thereto.

The material defining the hole 8 is thin, and in practice may have a thickness of about 0.4 mm.

In the case of the embodiments illustrated in FIGS. 1–4, the slot-carried element 7 and the corresponding hole 8 in the key 5 are round. The slot-carried element may have a diameter of between 1 and 3 mm.

In the case of the FIG. 5 embodiment, the slot-carried element has a square cross-section. The thickness of said element may vary correspondingly, i.e. from between 1 and 3 mm.

As will be evident from the aforegoing, the profiled shape of the slot-carried element may vary within wide limits and the element may optionally have an asymmetrical or fully irregular shape.

The width of the key slot 4 in the region of the spine or bottom part 5*e* of the key may be 2.5 mm as a maximum, although the width is often smaller in practice, e.g. about 2 mm.

In the case of the embodiments illustrated in FIGS. 1, 2, 4 and 6, in which the slot-carried element has a round cross-section, the axial hole 8 in the key 5 will suitably have a diameter which slightly exceeds the diameter of the element 7.

The blade or shank part 5*c* of the key in which the axial hole 8 is formed may have a more or less scrolled configuration, the thickness of these hole-defining parts being smaller than 0.5 mm, for instance 0.4 mm, as before mentioned.

Figure 7:
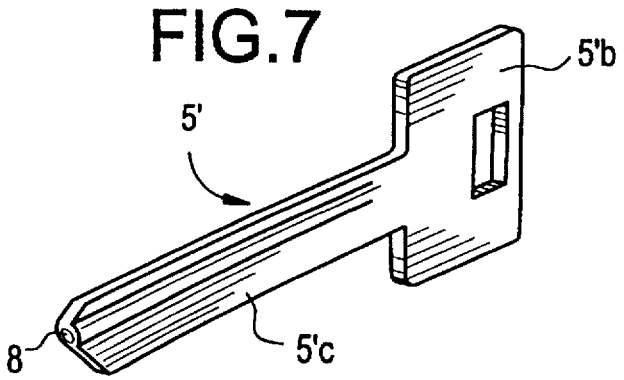
FIG. 7 is a perspective view of a key blank from which the key shown in FIG. 1 can be made.

FIG. 7 is a perspective view of a key blank 5' from which the key 5 shown in FIG. 1 can be produced. The key blank includes a grip part 5'*b* and a blade part 5'*c* and includes a part in which an axial hole 8 is provided for receiving a slot-carried element 7. The hole 8 is located eccentrically in relation to the centre line of a plug 3 with which a key 5 produced from said blank is intended to coact.

I claim:

1. A cylinder lock/key combination in which the cylinder lock (1) includes a lock cylinder (2), a plug (3) rotatably mounted in the cylinder (2) and provided with a key slot (4) having a rear end wall, a plurality of tumbler pins (6), which are activated by a key-code (5*a*) when the key (5) is inserted in the key-slot (4) , and which lock (1) is of the type where the blade part (5*c*) of the key (5) is not turnable relative to or within the slot (4), said combination comprising:

a rod-shaped element (7) which extends axially in a cantilever fashion in the key slot (4) and is secured at one end to the rear end wall of the key slot (4), wherein the key (5) comprises a grip part (5*b*), a coded (5*a*) blade part (5*c*), and an axially extending part (5*d*) which includes an axially extending hole (8), in which hole the rod-shaped element (7) is received as the key is inserted into the lock, and wherein the rod-shaped element (7) and the hole (8) in the key (5) are disposed eccentrically in relation to a center of the plug (3), so that as the key (5) is turned to activate rotation of the plug, the rod-shaped element (7) accompanies a rotational movement initiated by the key-activated rotation of the plug without forming a center for the rotational movement.

2. The combination of claim 1, wherein the rod-shaped element (7) can be removed from the plug (3), after having dismantled the plug from the lock cylinder (2).

3. The combination of claim 2, wherein the rear end wall comprises an end plate (9), the rod-shaped element (7) being disposed eccentrically on the end plate (9) which is detachably connectable to the plug.

4. The combination of claim 1, wherein the plug (3) includes a row of tumbler pins (6) whose axes lie in a symmetry plane through the center of the plug in a starting position for plug rotation, where a tumbler-pin parting plane is formed between the plug (3) and tumbler pins (6) mounted in the lock cylinder (2), and wherein an axial line through a center region of the rod-shaped element (7) and the hole (8) lies on one side of said symmetry plane.

5. The combination of claim 1, wherein the rod-shaped element (7) has a thickness or diameter of between 1 and 3 mm.

6. The combination of claim 1, wherein the key slot (4) has a width in a region of a bottom part (5*e*) of the key which is at most 3–3.5 mm.

7. The combination according to claim 1, wherein the rod-shaped element (7) extends along a substantial part of a length of the key slot (4).

8. A key comprising a grip part (5*b*), a blade part (5*c*) which includes a code (5*a*), and an axially extending key blade part (5*d*) provided with a hole (8) which is adapted to receive a rod-shaped element (7) which extends axially in a cantilever fashion and is secured at one end to a rear end wall of a slot (4) in a cylinder plug (3), wherein the hole (8) is located eccentrically in relation to a center of the plug when the key (5) is inserted into the key slot (4) in said plug (3), and that wherein the blade part (5*c*) is not turnable relative to or within the slot (4), so that turning of the key (5) in the key slot (4) initiates rotation of the plug (3) without said hole (8) in the key (5) which embraces said rod-shaped element (7) forming a center for said rotation.

9. A key according to claim 8, wherein portions of the key that define the hole (8) are, at least in part, thinner than 1 mm.

10. A key according to claim 9, wherein the hole is a circular bore (8), wherein the bore diameter being greater than 1.5 mm.

11. A key according to claim 9, wherein the hole has a shape other than round.

12. A blank (5') for producing a key (5), comprising a grip part (5'*b*) and a blade part (5'*c*), at least one of which has plane parallel side surfaces, wherein the blade part (5'*c*) includes a hole (8) for receiving a rod-shaped element (7) which extends axially in a cantilever fashion and is secured at one end to a rear end wall of a slot (4) in a cylinder plug (3), said hole (8) being located eccentrically in relation to a center of a lock plug (3) with which a key (5) produced from the blank is intended to coact, and wherein said hole (8) has a cross-sectional shape adapted to the cross-sectional shape of the rod-shaped element (7).

* * * * *